United States Patent [19]

Wood-Rethwill et al.

[11] Patent Number: 4,879,063

[45] Date of Patent: Nov. 7, 1989

[54] PROCESS FOR MAKING TRANSLUCENT SOAP BARS

[75] Inventors: Julianne C. Wood-Rethwill, Phoenix; Robert J. Jaworski, Scottsdale; E. Gary Myers; Michael L. Marshall, both of Scottsdale, all of Ariz.

[73] Assignee: The Dial Corporation, Phoenix, Ariz.

[21] Appl. No.: 58,923

[22] Filed: Jun. 5, 1987

[51] Int. Cl.[4] ..... C11D 13/18; C11D 13/04; C11D 17/00

[52] U.S. Cl. ..... 252/370; 252/134; 252/367; 252/368; 252/DIG. 16; 264/75

[58] Field of Search ..... 252/367, 368, 369, 370, 252/134, DIG. 16; 264/75; 425/197; 422/129.1

[56] References Cited

U.S. PATENT DOCUMENTS

| | | | |
|---|---|---|---|
| 3,155,624 | 11/1964 | Kelly | 252/122 |
| 3,864,272 | 2/1975 | Toma et al. | 252/125 |
| 3,923,438 | 12/1975 | Perla | 425/131.1 |
| 3,940,220 | 2/1976 | D'Arcangeli | 425/131.1 |
| 4,011,170 | 3/1977 | Pickin et al. | 252/134 |
| 4,169,067 | 12/1979 | Joshi | 252/132 |
| 4,256,600 | 3/1981 | Lewis et al. | 252/132 |
| 4,490,280 | 12/1984 | Joshi et al. | 252/368 |
| 4,493,786 | 1/1985 | Joshi | 252/368 |
| 4,517,107 | 5/1985 | Clarke et al. | 252/108 |

FOREIGN PATENT DOCUMENTS

| | | |
|---|---|---|
| 2006666 | 8/1971 | Fed. Rep. of Germany . |
| 73038445 | 3/1969 | Japan . |
| 77009442 | 3/1971 | Japan . |
| 71004253 | 5/1971 | Japan . |
| 79043522 | 12/1979 | Japan . |
| 8242800 | 3/1982 | Japan . |
| 60181199 | 9/1985 | Japan . |
| 2118450 | 11/1983 | United Kingdom . |
| 2118854 | 11/1983 | United Kingdom . |

OTHER PUBLICATIONS

H. Goldschmeidt, *Transparent Soaps,* Soap/Cosmetics/-Chemical Specialties, Jun. 1972, pp. 37–38.

G. R. Whalley, *Transparent Soaps,* Perfumes & Escential Oil Record, Jul. 1967, pp. 465–468.

E. T. Webb, *Transparent Soaps,* Soap Perfumery, Cosmetics, Aug. 1958, pp. 770–772.

J. V. Wells, *Transparent Soaps,* Soap and Chemical Specialties, Jun. 1955, pp. 39–41, Jul. 1955, pp. 43–46 & 114.

E. T. Webb, *Transparent Soap,* American Perfumes and Cosmetics, vol. 82, Apr. 1967, pp. 41–44.

*Transparent Soap Bars–Past and Present,* Soap/Chemical Specialties, Oct. 1967, pp. 102, 104, 106, 114–115.

*Primary Examiner*—Paul Lieberman
*Assistant Examiner*—Kathleen Markowski
*Attorney, Agent, or Firm*—Richard G. Harrer; Bernard L. Howard

[57] ABSTRACT

A continuous, high speed process for making translucent soap bars which, optionally are provided with a striated pattern. The process uses a mixture of tallow and coconut fatty acids saponified with a mixture of sodium hydroxide and potassium hydroxide. To the neat soap is added a superfatting agent and glycerin and the resulting neat soap is dried to a moisture level of from about 14% to about 18%. The dried soap is thereafter subject to amalgamation where a slurry containing additional glycerin and a polyethylene glycol of molecular weight of about 600 is added to and mixed with said soap. Following amalgamation, the soap is refined and thereafter compacted and extruded into a continuous log which may be cut and stamped into bars. A striated pattern may be incorporated into the translucent bars by adding mica platelets to the slurry at the amalgamation stage and conducting the compaction and extrusion of said soap in an extrusion plodder provided with a compaction plate, such plate having a series of openings through which the soap is forced resulting in soap bars having a unique striated pattern.

10 Claims, 2 Drawing Sheets

PROCESS FOR MAKING TRANSLUCENT SOAP BARS

FIELD OF THE INVENTION

This invention relates to a process for making translucent soap in bar form and more particularly to a high speed, continuous process for making bar soaps having a consistently high degree of translucency. Additionally, the invention includes a process for providing such translucent soaps with a unique pearlescent, striated pattern.

BACKGROUND OF THE INVENTION

Both translucent and transparent soaps have been available for many years; indeed it is said that a transparent toilet soap was available in England as early as 1789. Initially such soaps were made by incorporating substantial amounts of soap crystallization inhibitors, such as lower alcohols, glycerin and/or sugar and by framing the soap. Such soaps were relatively soft. It was subsequently learned that milled and plodded translucent soaps could be made by various techniques. For example, in Toma et al U.S. Pat. No. 3,864,272 there is disclosed a process for making translucent soap which is said to be of the hard milled variety. In Toma a blend of tallow and coco fatty acids (70–85% tallow and 15–30% coco) is saponified with a mixture of sodium hydroxide and potassium hydroxide. It is indicated that a small amount of glycerin can be added to the mixture prior to saponification. After the saponification has been completed and neat soap is formed, to aid translucency small quantities of polyethylene glycol and propylene glycol are added along with some glycerin prior to drying. After the neat soap has been dried and pellets formed, the pellets are transferred to an amalgamator where perfume and coloring matter are added. It is further stated that in the interest of translucency there should be added at this stage (amalgamator) a quantity of polyethylene glycol and propylene glycol on the order of 0.3–0.9% of each. Following the amalgamator stage, the soap is refined and then extruded and cut into slugs prior to stamping.

SUMMARY OF THE INVENTION

In accordance with one aspect of this invention there is provided a high speed, continuous process for producing translucent soaps which can be formed into bars. The process is unique in that the resulting bar soap products have good translucency that is consistently obtained even at line speeds of at least 250 bars per minute. The process results in soap bar products that are of consistently high quality with respect to other aspects of bar soaps in general.

In another aspect of the invention there is disclosed a technique for providing translucent soap bars with an eye appealing, pearlescent, striated pattern, which pattern can be readily varied with minor changes in equipment used in the production of the soaps.

DESCRIPTION OF THE PREFERRED EMBODIMENTS

Figure 1:
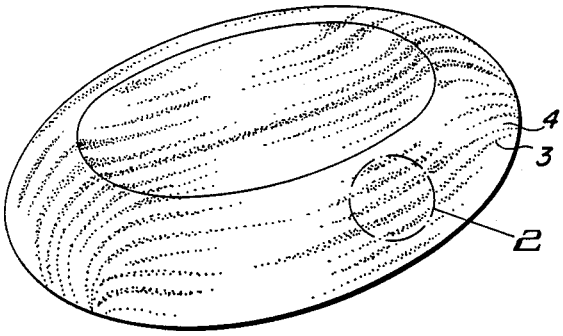
FIG. 1 is a perspective view of a bar of translucent soap with a striated pattern.

Soap is usually made by the saponification of fatty acids, or esters (fats and oils) by either the so-called "kettle" process or the continuous process. In the latter process fat is split into the various fatty acids and the acids are then neutralized with caustic. Another method is the cold process, which has limited commercial use today. No matter which process is employed, the end product of the saponification procedure is called neat soap containing usually from about 30–32% water. Although our process can utilize either the kettle or continuous process for making soap, we prefer the continuous process since better quality is generally obtained. Moreover, glycerin concentration is simplified and the resulting finished glycerin is usually of higher quality. After the neat soap is produced, it can be dried using several methods. One is the Proctor-Schwartz atmospheric drying method, in which the neat soap is poured over steam heated rolls and flake dried. A vacuum dryer can also be used, in which the neat soap is heated to about 280°F. and sprayed against the walls of the vacuum dryer, at 27–28 inches of Hg., where the soap is dried and removed by a rotating scraper. This dried soap is plodded and is usually extruded in the form of a pellet. Following drying the soap customarily goes through the stages of amalgamation, refining, compacting and extruding, cutting, and lastly pressing into soap bars usually with an identifying logo and desirable shape. The purpose of amalgamation is to add perfume, color and other ingredients to soap pellets, using a mixing vessel called an amalgamator. By refining is meant the process of completing the mixing and making the soap more uniform, using a so-called refining plodder. The compacting and extruding stages have as their purpose to compact the soap and deliberate continuous log of soap to be cut, usually using an extruding plodder. Our improved process for producing translucent soap bars utilizes conventional equipment found in a modern soap making operation.

We have discovered that the quality of translucency in bar soap products can be substantially advanced by adhering to the following factors:

(1) Use of a blend of tallow fat and coconut oil, palm kernel oil or other fats and oils useful in the production of soaps or the corresponding fatty acids derived therefrom.

(2) The alkaline material to saponify the foregoing fats, oils and fatty acids should consist of both sodium hydroxide and potassium hydroxide.

(3) Superfat to be added at the neat soap stage.

(4) Glycerin to be added at both the neat soap and amalgamation stages.

(5) Use of a polyethylene glycol of average molecular weight of 600 (PEG -12). A portion can be added at the neat soap stage and the balance at the amalgamation stage. Preferably, all of the polyethylene glycol is added at the amalgamation stage.

(6) The moisture level of the soap from the dryer should be carefully controlled.

(7) Any slurry added at the amalgamation stage should be non-aqueous.

(8) The holes of the screens employed in the refining stage should be no greater than about U.S. No. 20 mesh (0.8 mm.).

As disclosed in the Toma patent, we find that it is important that in the neutralization of fatty acids to obtain neat soap, the acids should be a mixture obtained from tallow and from coconut oil or palm kernel oil in the proportion from about 70–85% tallow acids to from about 15–30% coconut or palm kernel oil acids with best results being obtained using about 80% tallow acids to about 20% coconut acids. The alkaline material utilized in the saponification step should consist of about 90–95% sodium hydroxide and from 5–10% of potassium hydroxide, the foregoing percentages being based on the total weight of the alkali. Best results are obtained when using about 95% sodium hydroxide and 5% potassium hydroxide. In addition to the foregoing basic ingredients, small amounts of chelants may be included in the saponification mixture as well as water for the adjustment of moisture. Water used for the dilution of the alkali and chelants and any water used to adjust the moisture content of the neat soap should have low calcium and magnesium ion content for optimum translucency in the finished bar. If salt is included in the neat soap it should be present in the range of from about 0.4 to 0.6% based on the total weight of the saponification mixture. Higher salt concentrations inhibit the development of translucency.

Once saponification is completed and neat soap is formed, it is important to add a superfatting agent to the neat soap mixture. As a superfatting agent we prefer to add from about 1.2 to about 2.0% of stearic acid although coco fatty acid can be used as well. When using coco fatty acid the resulting bars are not quite as translucent as when stearic acid is used. Additionally, glycerin is added to the neat soap in an amount ranging from about 0.8 to about 2.1% by weight of the neat soap.

Polyethylene glycol of molecular weight of about 600 may be added at the neat soap stage, although it is preferable to add all the glycol at the amalgamation stage. If any of the glycol is added at the neat soap stage, the amount so added can range up to 1.2% by weight of the neat soap.

Following the neat soap stage, the neat soap is dried to a moisture level ranging between 14 to 18%. If the moisture level drops below 14%, then increased opacity results. Correspondingly, if the moisture level exceeds about 18% by weight, then further processing on high speed equipment is not feasible.

In a typical soap making operation, after the soap is dried it is usually pelletized and then subject to the amalgamation in a piece of equipment called an amalgamator. To achieve maximum translucency, the dried soap having a moisture level of 14 to 18% should be subject to a pre-refining step prior to processing in the amalgamator. This pre-refining step can be accomplished in a refining plodder provided with a screen, the hole size of the screen being no greater than U.S. 20 mesh (0.8 mm.). Hole size greater than 0.8 mm. results in inferior translucency.

After the pre-refining step the soap is transferred to an amalgamator where a non-aqueous slurry of colorant, perfume and other additives that are desired in the final product are added. It is at this stage that additional glycerin and polyethylene glycol is added to the soap. With respect to the glycerin, the total amount present in the soap bar should range from about 1.3% to about 3.5% by weight of the soap. Of the foregoing amount, one can add between about 0.8% and 2.1% of glycerin by weight of the neat soap. When this is done, the total amount of glycerin added to both the neat soap and amalgamation stages should be such that the total amount of glycerin does not exceed 3.5% of the weight of the soap. At the amalgamator stage the minimum amount added should be at least about 0.5% by weight of the soap. The amount of PEG present in the soap bar can range from about 2.5 to about 4.5% by weight of the soap, preferably from about 3.0% to about 4.0%. If some of the PEG is added at the neat soap stage, up to about 1.2% by weight of the neat soap, this should be taken into account when calculating the amount added at the amalgamation stage. The preferred glycol is PEG-12 having a molecular weight of about 600 and which is the polymer of ethylene oxide that conforms generally to the formula:

$$H(OCH_2CH_2)_nOH$$

where n has an average value of 12. It is important at the amalgamation stage that all additives be as non-aqueous as possible, with no water intentionally added.

Following mixing in the amalgamator for a period generally ranging from 3–5 minutes, the formulated soap pellets are transferred to the first section of the so-called refining operation. By refining we mean continued mixing of the soap and this can be readily accomplished using a refining plodder which is well-known in the art. It is preferred to process the soap through two stages of refining to obtain maximum translucency. The refining plodder should be fitted with screens ranging from 20 U.S. mesh to 28 U.S. mesh. If a mesh size larger than 20 U.S. mesh is used, the translucency of the bar will be adversely effected.

The final stage of the process comprises compacting and extruding the soap to deliver a continuous log of soap which is then cut into appropriate lengths suitable for pressing into a bar of desired shape. This can be accomplished in a vacuum extrusion plodder which is well-known in the art. A so-called duplex vacuum plodder which is a tandum arrangement of two simplex plodders is preferred. In extruding the soap, it is preferred that chilled water (60°–68°F.) be circulated through the plodder barrel jacket prior to forming a continuous log so as to maintain the temperature of the extruded log of soap in the range of 95°–110°F.

It has been thought that translucent bars processed at high speed would require the use of a conditioning tunnel prior to pressing or stamping. Such tunnels are available in both refrigerated and non-refrigerated types and are designed to cool the external surface of the soap by passing a stream of air over it to facilitate pressing. The use of such conditioning tunnels have been particularly useful with respect to so-called "sticky" bar formulation such as highly superfatted bars and the like. However, we find that with respect to the process as disclosed herein no such conditioning is required and pressing of the bars is accomplished without problem.

A unique, striated pattern may be obtained in the translucent soap bars by incorporating into the soap at the amalgamation stage titanium oxide coated mica platelets and thereafter processing the soap through the refining operation, and ultimately through a modified compaction plate in the cone area of a vacuum extrusion plodder. FIG. 1 shows a perspective view of a bar of translucent soap showing such a striated pattern. This pattern, as shown more clearly in FIG. 2 consists of alternating bands 3 and 4 which are visually quite distinct. To the eye band 4 appears considerably more translucent than band 3 and results from the particular arrangement of the mica platelets in the soap mass which results when the soap passes through a compaction plate in the cone area of the plodder.

Figure 4:
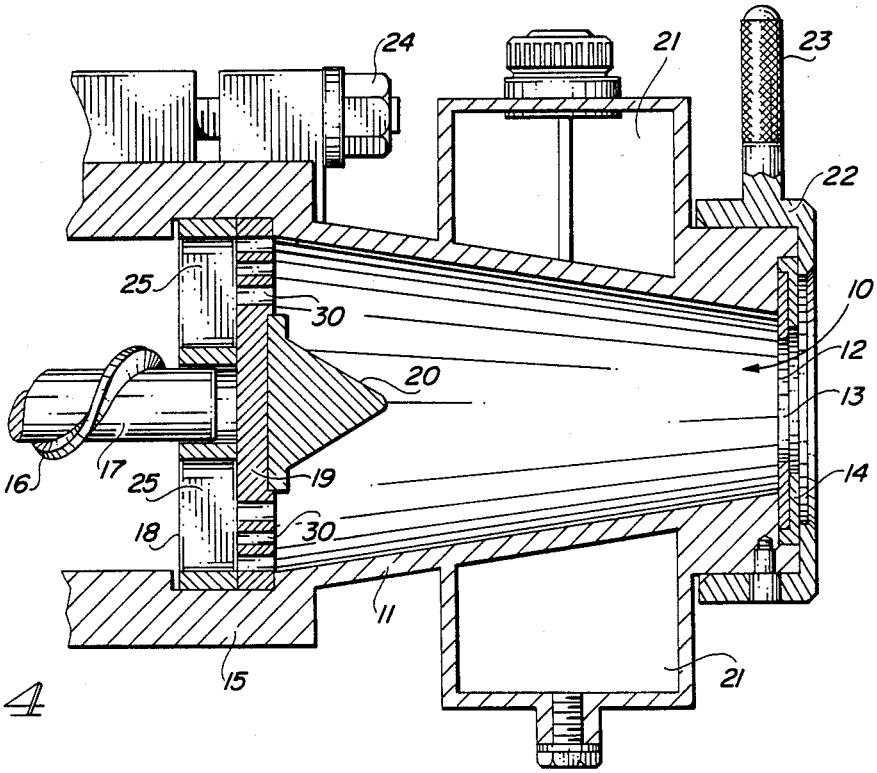
FIG. 4 is a side view in section of the cone area of a plodder as shown generally in FIG. 3.

As shown in FIG. 4 the cone area of a typical extrusion plodder shown generally at 10 includes a tapered housing 11, extrusion plate 12 which is held in position by extrusion support plate 14. The extrusion plate is provided with a generally rectangular opening 13 and controls the shape of the soap log as it exits from the extrusion plodder. An extrusion worm is revolvably mounted in the barrel 15 of the plodder and although not shown in its entirety it consists of a helix 16 mounted on shaft 17 which is supported by support 18 called a "worm support". Mounted at the end of barrel 15 is compaction plate 19, examples of which are shown in greater detail in FIGS. 5 and 6. Attached to compaction plate 19 by bolts not shown is a generally cone shaped device 20 which serves to control the flow of soap in the tapered cone area. Surrounding the tapered cone area is chamber or gallery 21 which serves to contain a heated fluid such as oil to control the temperature of the soap as it moves through the cone area, and ultimately through opening 13 of extrusion plate 12 to form the soap log. The extrusion plate 12 and extrusion support plate 14 are held in position at the end of the tapered cone by means of a locking mechanism 22 which can be rotated by handle 23 to secure or release the extrusion plate to or from the tapered housing 11. The tapered cone is secured to the plodder barrel 15 by means of bolts 24.

In soap processing, the refined soap is moved through the barrel of the plodder by means of the extrusion worm, then through the openings 25 of the worm support and then optionally through a compaction plate into the tapered cone area and ultimately through the opening 13 of the extrusion plate to form a soap log.

Figure 3:
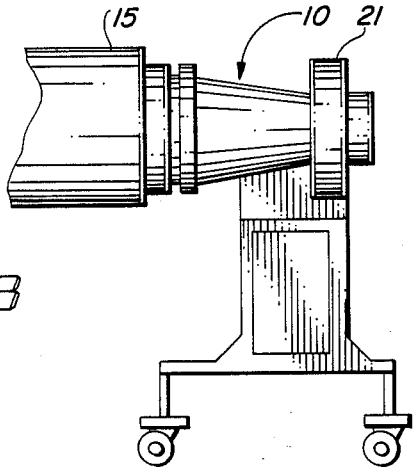
FIG. 3 is a side view of a portion of the barrel and all of the tapered cone area of an extrusion plodder.

In producing a striated soap bar as shown in FIG. 1 with the distinctive bands 3 and 4 a quantity of mica platelets or other planar pearlescent material, preferably coated with a reflective material such as titanium dioxide, is introduced at the amalgamation stage. The platelets are added to the non-aqueous slurry which is then added to the amalgamator along with the soap pellets. It has been found that the platelets range in size from 10 to 100 microns in length and that the quantity of platelets added can range from about 0.2 to about 0.5% by weight of the finished soap. After suitable mixing in the amalgamator, the soap mass is subject to the refining operation. Thereafter the refined soap is delivered to a vacuum extrusion plodder such as partially shown in FIGS. 3 and 4, passes through the openings 25 of the worm support and through the holes 30 of the compaction plate 19 into the cone area. The soap is finally extruded as a continuous log through opening 13 of extrusion plate 12.

Figure 2:
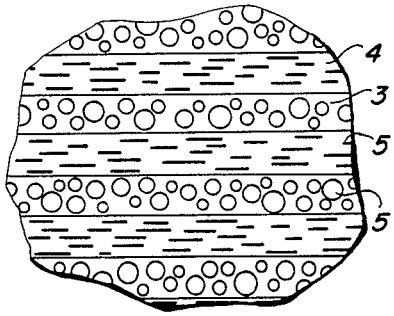
FIG. 2 is an enlarged view of an area designated as "2" of FIG. 1.
Figure 5:
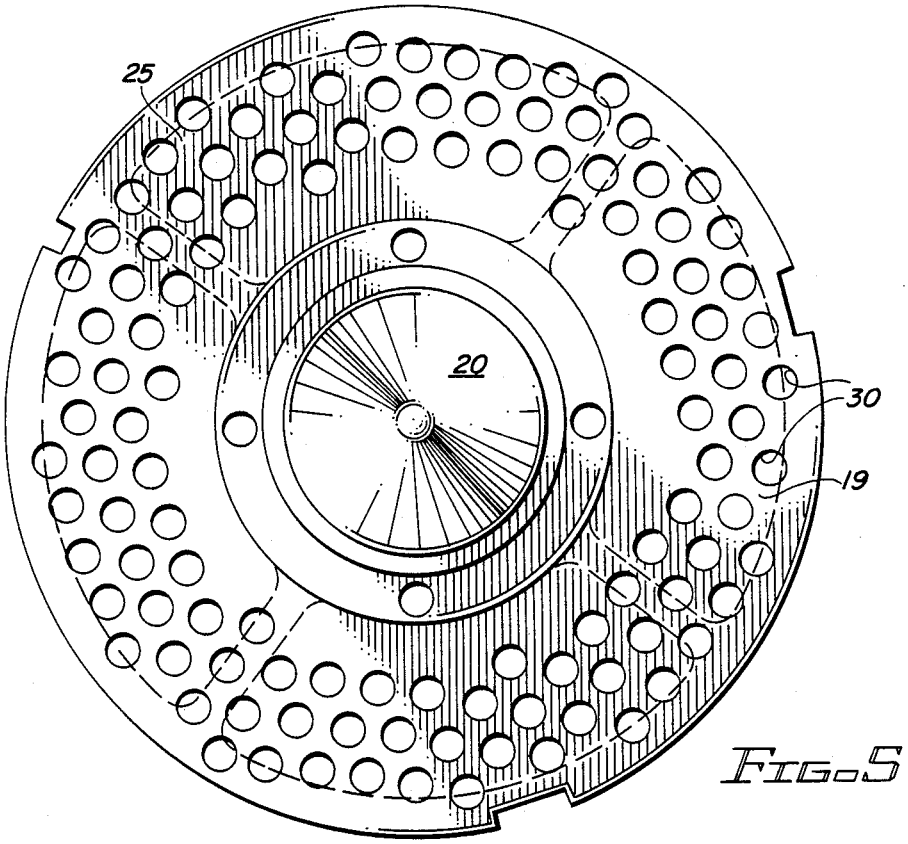
FIG. 5 is a plan view of a compaction plate for use in the apparatus shown in FIG. 4.
Figure 6:
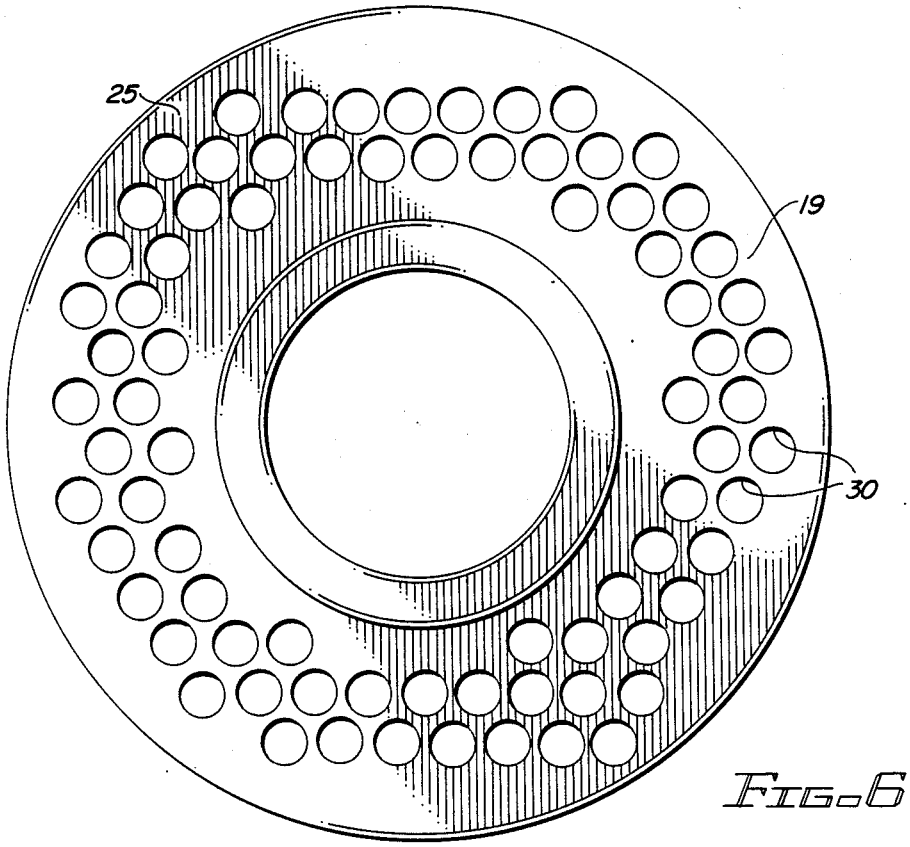
FIG. 6 is a plan view of a modified compaction plate for use in the apparatus shown in FIG. 4.

In producing a striated pattern in a soap bar such as is shown in FIGS. 1 and 2, it has been found that passing the soap mass through a compaction plate as shown in FIGS. 5 and 6 causes alignment of the mica platelets in a particular manner which results in the unique striated appearance of the soap bar. Referring to FIG. 2, it will be seen that platelets 5 in band 3 are aligned more or less so that the flat surfaces of the platelets are exposed to the eye. However, in band 4 the platelets are aligned so that they are more or less "on edge" and the eye of the viewer does not really see the platelets to the extent of those of band 3. This platelet alignment takes place as the soap containing the platelets is forced through the holes 30 of the compaction plate 19.

It has been further found that in producing the striated soap bar, an important factor is the ratio of the total open area 25 of the worm support to the total open area (holes 30) of the compaction plate. The optimum ratio is about 2.6:1; that is, the total open area of the worm support is preferably 2.6 times greater than the total open area of the compaction plate. This ratio can range from about 2:1 to about 3:1.

The striated pattern is also governed by the number and size of the openings in the compaction plate. Generally, more openings in the compaction plate results in narrower bands 3 and 4 and with a somewhat less visible pattern. With fewer openings, and with each opening therefore being larger in diameter, the bands are wider and more visible to the eye.

In translating the foregoing to available extrusion plodders of 8 inch, 12 inch and 16 inch diameters, the following is the optimum ratio of open area of worm support to compaction plate:

| Plodder Size | Worm Support Area | Compaction Plate Area |
|---|---|---|
| 8 inch | 33.25 in.$^2$ | 12.64 in.$^2$ |
| 12 inch | 79.50 in.$^2$ | 30.21 in.$^2$ |
| 16 inch | 152.40 in.$^2$ | 57.91 in.$^2$ |

Referring again to FIGS. 5 and 6 it will be seen that there are more openings 30 in the compaction plate of FIG. 5 than the compaction plate of FIG. 6. Moreover, since the overall area of the openings is limited by the ratio of the open area of the worm support to the open area of the plate, the size of each opening in the plate of FIG. 5 is necessarily smaller. It has been determined that the individual openings in the compaction plate should be no less than about 0.25 inches in diameter.

In the following examples, the measurement of the translucency of a soap bar ("Translucency Index" or "T.I.") was determined by reading print of a given size through a slice of the bar soap of given thickness (2/8–$\frac{3}{8}$ inch). The print size ranges from 21 mm. to $\frac{1}{2}$mm. and the Translucency Index or T.I. is shown below.

| T.I. (Translucency Index) | Print Size |
|---|---|
| 1 | 21 mm. |
| 2 | 11 mm. |
| 3 | 5 mm. |
| 4 | 4 mm. |
| 5 | 3 mm. |
| 6 | 2 mm. |
| 7 | 1.5 mm. |
| 8 | 1 mm. |
| 9 | 0.5 mm. |

A "0" is given if the 21 mm. print size cannot be read.

A T.I. of 3 to 5 denotes a bar of good translucency. A T.I. of 0 denotes an opaque bar.

EXAMPLE I

Using the continuous process of soap making, an 80/20 tallow/coconut fatty acid blend was saponified with a blend of 90% NaOH and 10% KOH. Thereafter, 0.6% of salt, 0.8% of glycerin and 2%of stearic acid (superfat) were added to the neat soap which was then dried and formed into pellets having a moisture level of 16%. The pellets were transferred to an amalgamator where polyethylene glycols of varying molecular weights were added. Thereafter the soap mass was refined through two 0.5 mm. screens, extruded, cut and stamped into bars.

The Translucency Index of each bar was determined with the following results.

| Polyethylene Glycol | Level | T.I. |
|---|---|---|
| Molecular Weight 1000 | 3% | 1 |
| Molecular Weight 1000 | 4% | 1 |
| Molecular Weight 600 | 3.5% | 2 |
| Molecular Weight 600 | 3.8% | 3.5 |
| Molecular Weight 350 | 3.8% | 2 |

It is concluded that polyethylene glycol of molecular weight of 600 produces superior translucency to polyethylene glycols having higher or lower molecular weights.

EXAMPLE II

A study was undertaken to compare the process of the Toma et al U.S. Pat. No. 3,864,272 to the process of this invention With regard to the Toma et al patent an 80/20 tallow/coconut blend of fatty acids was saponified with a 95/5 blend of NaOH/KOH. 1.5% each of polyethylene glycol of 1000 molecular weight and polypropylene glycol were added to the neat soap along with 0.6% of salt and the neat soap was dried and formed into pellets having 18% moisture. It was noted that processing of the soap mass in the drier was so difficult and that formation of pellets was not possible.

An 80/20 tallow/coconut blend of fatty acids was saponified with a 90/10 blend of NaOH/KOH. After saponification was complete, 2% of stearic acid, 0.8% of glycerin and 0.6% salt were added to the neat soap. After drying and formation of pellets the pellet moisture was determined to be between 14 and 15%. The pellets were transferred to an amalgamator and mixed with 3.8% (based on finished bar weight) of PEG -12 (MW600).

Thereafter, the soap was refined, extruded, cut and stamped into bars. The T.I. of such bars was 3.

EXAMPLE III

To determine the effect of adding glycerin to the soap at the amalgamation stage, an 80/20 blend of tallow/coconut fatty acid was saponified with a 90/10 blend of NaOH/KOH along with 0.6% salt and 0.8% glycerin. The neat soap was dried to 15% moisture and formed into pellets. The pellets were mixed with varying amounts of glycerin and PEG -12 (MW600) in the amalgamator, refined, and the soap mass was then extruded, cut and stamped into bars with the following results.

| Addition at Amalgamator; (%) of Bar Weight | | |
|---|---|---|
| Glycerin | | PEG-12 |
| 0 | | 3.8 |
| 2 | | 3.8 |
| 2 | | 3.0 |
| T.I. | T.I. (2 Weeks) | T.I. (4 Weeks) |
| 2.5 | 5.0 | 4.0 |

-continued

| Addition at Amalgamator; (%) of Bar Weight | | |
|---|---|---|
| 4.0 | 9.0 | 9.0 |
| 4.0 | 10.0 | 9.0 |

It was observed that the addition of 2% glycerin significantly improved translucency as well as firmness during processing of the bars. It should be noted that the T.I. of the bars increased upon storage and stabilized at about 2 weeks after production.

EXAMPLE IV

An 80/20 tallow/coconut blend of fatty acids was saponified with a 90/10 blend of NaOH and KOH. Thereafter, 0.6% salt and 0.8% glycerin were added to the neat soap. After drying the moisture level of the pellets was at 13% for one batch and 14% for another batch Glycerin, at 2.0% of the finished bar weight and PEG -12, at 3.8% were added to each batch of pellets at the amalgamation stage. Both batches were refined through two screens of 0.5 mm., extruded, cut and stamped.

The Translucency Index was determined as follows:

| Average Pellet Moisture | T.I. |
|---|---|
| 13.0% | 1.0 |
| 14.0% | 4.0 |

It was concluded that a minimum moisture level of about 14% in the soap pellets is necessary to produce soap bars of good translucency.

EXAMPLE V

An 80/20 tallow/coconut fatty acid blend was saponified with a 90/10 blend of NaOH/KOH. Thereafter 0.6% salt, 1.4% glycerin and 2.1% stearic acid were added to the neat soap. The moisture level of the pellets formed after drying was about 15%. These pellets were then pre-refined through a 0.5 mm. screen and amalgamated with a non-aqueous slurry. The slurry consisted of perfume, 3.8% of PEG -12, 1.3% glycerin, 0.25% titanium dioxide coated mica platelets and colorant, the foregoing percentages based on finished bar weight. Following amalgamation, the pellets were refined in an eight inch refining plodder fitted with two 0.8 mm. screens in the first and second stages of the refining plodder. After refining, the soap mass was delivered to an eight inch extrusion plodder fitted with a compaction plate in front of the worm support. The compaction plate was configured with 116 holes each of ⅜ inch diameter. The ratio of open area of the worm support to the open area of the plate was 2.6:1. The soap mass was then extruded through the plate, cut and stamped. It was visually noted that the bars possessed a very distinct striated pattern of the type shown in FIGS. 1 and 2. A soap of the same formulation was processed through an extrusion plodder without the compaction plate and no striated pattern was present in the bars.

EXAMPLE VI

An 80/20 tallow/coconut fatty acid blend was saponified with a 95/5 NaOH/KOH caustic blend. Thereafter 0.6% salt, 1.6% glycerin and 2.1% stearic acid were added to the neat soap. The moisture level of the pellets formed after drying Was about 16%. The pellets were pre-refined through a 0.5 mm. screen and then amalgamated with a non-aqueous slurry which included about 0.95% of perfume. The balance of the slurry consisted of 3.8% PEG-12, 0.5% glycerin, 0.25% of titanium dioxide coated mica platelets and colorant, the foregoing percentages based on finished bar weight. Following amalgamation, the pellets were refined in a twelve inch refining plodder fitted with two 0.5 mm. screens in the first and second stages of the refining plodder. Following refining, the soap mass was delivered to a twelve inch extrusion plodder fitted with a compaction plate in front of the worm support of the type shown in FIG. 6. The plate configured with 74 holes each of ¾ inch diameter. The ratio of open area of the worm support to the open area of the plate was 2.6:1. The soap was extruded through the compaction plate, cut and stamped into bars. The bars possessed a very distinctive pearlescent, striated appearance of the type shown in FIGS. 1 and 2.

We claim:

1. In a process for the production of translucent soap wherein a blend of tallow fat and coconut oil or other fats and oils useful in the production of soap or the corresponding fatty acids derived therefrom are saponified or neutralized, with the resulting neat soap being dried, amalgamated, refined and formed in bars, the improvement comprising:

conducting the saponification or neutralization with a mixture of from about 90–95% sodium hydroxide and from about 5–10% of potassium hydroxide, adding to the resulting neat soap from about 0.8 to about 2.1% of glycerin, from about 1.2 to about 2.0% of a superfatting agent and from about 0 to about 1.2% of a polyethylene glycol having a molecular weight of about 600, the foregoing percentages being based on the weight of the neat soap, drying said neat soap to a moisture level of from about 14% to about 18%, thereafter passing the dried soap through a refining plodder provided with a screen having hole sizes no greater than 0.8 mm., subjecting the refined soap to amalgamation where a non-aqueous slurry containing polyethylene glycol having an average molecular weight of about 600 and additional glycerin is added to and mixed with said soap, the amount of said polyethylene glycol added to said soap being from about 2.5 to about 4.5% by weight of said soap including any of said polyethylene glycol that is added to said neat soap, the amount of glycerin so added being at least about 0.5% by weight of said soap with the total amount of glycerin in said soap including that added to the heat soap not exceeding 3.5% of the weight of said soap, subjecting said soap to refining using a screen having openings no greater than about 0.8 mm. and thereafter compacting and extruding said soap in a continuous log which can be cut and stamped into bars.

2. The process of claim 1 wherein the moisture level of said dried soap is from about 14% to about 16%.

3. The process of claim 1 wherein a planar reflective material is added to said soap during amalgamation and wherein the compacting and extruding of said soap is in an extrusion plodder having an extrusion worm mounted to a worm support having openings therein, and a compaction plate mounted adjacent to said support, said compaction plate being provided with series of openings through which said soap is forced, and wherein the ratio of the total open area of said worm support to the total amount of the openings of said compaction plate is from about 2:1 to about 3:1.

4. The process of claim 3 wherein said ratio is about 2.6:1.

5. The process of claim 3 wherein said planar material is mica.

6. The process of claim 1 wherein the amount of said polyethylene glycol added to said soap is from about 3.0 to about 4.0% by weight of said soap.

7. A process for the production of translucent bar soap having a striated pattern comprising saponifying a blend of tallow and coconut fatty acids with an alkali mixture of sodium hydroxide and potassium hydroxide, adding from about 0.8 to about 2.1% glycerin and from about 1.2 to about 2.0% superfatting agent to the resulting neat soap, the foregoing percentages being based on the weight of the neat soap, drying said neat soap to a moisture level of from about 14% to about 18%, subjecting the dried soap to amalgamation wherein a slurry containing polyethylene glycol with an average molecular weight of 600, additional glycerin and a planar reflective material are added to and mixed with said soap, the amount of said polyethylene glycol added to said soap being from about 2.5 to about 4.5% by weight of said soap and the amount of glycerin so added being at least about 0.5% by weight of said soap with the total amount of glycerin in said soap not exceeding 3.5% by weight of said soap, subjecting said soap to refining using a screen having openings no greater than about 0.8 mm., and thereafter compacting and extruding said soap in an extrusion plodder having an extrusion worm mounted to a worm support having openings therein, and a compaction plate mounted adjacent to said support, said compaction plate being provided with a series of openings through which said soap is forced, and wherein the ratio of the total open area of said worm support to the total area of the openings in said compaction plate is from 2:1 to about 3:1.

8. The process of claim 7 wherein said soap contains from about 3.0% to about 4.0% of said glycol by weight of said soap and wherein the total amount of glycerin in said soap is from about 1.3% to about 3.5% by weight of said soap.

9. The process of claim 8 wherein said fatty acids are a blend of from about 70–85% tallow acids to from about 15–30% coconut fatty acids.

10. The process of claim 7 wherein said fatty acids are a blend of 80% tallow acids and 20% coco acids, said alkali is a blend of 95% NaOH and 5% KOH, said neat soap contains 0.6% salt, 1.6% glycerin and 2.1% stearic acid, said neat soap being dried to a moisture level of about 16%, said dried soap thereafter being pre-refined and then amalgamated with a non-aqueous slurry containing 3.8% of polyethylene glycol having an average molecular weight of 600, 0.5% glycerin and 0.25% of mica platelets, and a colorant, thereafter refining said soap using screens having 0.5 mm. openings, and wherein the ratio of the total open area of said worm support to the total area of the openings in said compaction plate is about 2.6:1.

* * * * *